US012096893B2

(12) United States Patent
Neal

(10) Patent No.: US 12,096,893 B2
(45) Date of Patent: Sep. 24, 2024

(54) POUCHED WASHCLOTH FOR STORING A SOAP BAR

(71) Applicant: Marquis Neal, Niagara Falls, NY (US)

(72) Inventor: Marquis Neal, Niagara Falls, NY (US)

( * ) Notice: Subject to any disclaimer, the term of this patent is extended or adjusted under 35 U.S.C. 154(b) by 22 days.

(21) Appl. No.: 17/940,118

(22) Filed: Sep. 8, 2022

(65) Prior Publication Data

US 2023/0090471 A1 Mar. 23, 2023

Related U.S. Application Data

(60) Provisional application No. 63/245,874, filed on Sep. 19, 2021.

(51) Int. Cl.
*A47K 7/02* (2006.01)
*A47K 7/03* (2006.01)

(52) U.S. Cl.
CPC . *A47K 7/03* (2013.01); *A47K 7/02* (2013.01)

(58) Field of Classification Search
CPC ..... A47K 7/02; A47K 7/03
USPC ..... 401/201
See application file for complete search history.

(56) References Cited

U.S. PATENT DOCUMENTS

| | | | | |
|---|---|---|---|---|
| 6,644,881 | B1 * | 11/2003 | Dawan | A47K 7/03 15/208 |
| 7,014,381 | B1 * | 3/2006 | Graham | A47K 7/03 401/201 |
| 2005/0186016 | A1 * | 8/2005 | O'Brie | A47K 7/03 401/201 |
| 2006/0280547 | A1 * | 12/2006 | Wyatt | A47K 7/03 401/196 |
| 2012/0191108 | A1 * | 7/2012 | Thomas | A47K 7/03 606/131 |
| 2015/0020335 | A1 * | 1/2015 | Soutullo | A47K 7/03 15/209.1 |
| 2022/0330763 | A1 * | 10/2022 | Hester | A47K 7/03 |

* cited by examiner

*Primary Examiner* — Jennifer C Chiang
(74) *Attorney, Agent, or Firm* — Brennan, Manna & Diamond, LLC

(57) ABSTRACT

A soap bar holding pouched washcloth having an integrated pouch for storing a bar of soap for lathering the washcloth for bathing. The washcloth features a pouch sewn along the longitudinal edges and one of the transversal edges of the washcloth, a trailing edge of the washcloth forms an opening for a cavity created by the pouch for storing the soap bar, thereby enabling a user to take a shower using the washcloth with the soap bar accommodated in the pouch without independently applying the soap bar. The soap bar creates lather when it comes into contact with water enabling the user to clean the body by rubbing the lathered washcloth thereon. The washcloth is washable and can comprise of different sizes and designs.

16 Claims, 4 Drawing Sheets

POUCHED WASHCLOTH FOR STORING A SOAP BAR

CROSS-REFERENCE TO RELATED APPLICATION

The present application claims priority to, and the benefit of, U.S. Provisional Application No. 63/245,874, which was filed on Sep. 19, 2021, and is incorporated herein by reference in its entirety.

FIELD OF THE INVENTION

The present invention relates generally to the field of washcloths. More specifically, the present invention relates to a novel pouched washcloth that is designed to have a small pouch integrated into one side for holding a soap bar. The pouch enables users to place soap bar in the washcloth for lathering the cloth rather than independently applying the soap. The pouch is sized to securely store the soap bar and therefore, prevents soap from falling on the shower or bath floor and risking slips and falls. The washcloth with accommodated soap bar can be used by users for taking a shower. Accordingly, the present disclosure makes specific reference thereto. Nonetheless, it is to be appreciated that aspects of the present invention are also equally applicable to other like applications, devices, and methods of manufacture.

BACKGROUND

By way of background, soap is one of the most popular cosmetics used for applying on the body during a bath for cleaning the body. Soaps can be found in almost every bathroom and are used by individuals of all ages and genders. Conventionally, all soaps are basic in nature and include long carbon chains of sodium and potassium which are slippery in nature. Further, soaps contain oil which also makes the soaps slippery while soaps are used with water. As a result, when soap is applied and comes in contact with water, the soap becomes slippery and slips out of the hand of a user. This may cause a slippery floor and individuals may accidentally slip and fall suffering serious injuries. Further, bending to pick up soap from the floor is also discomforting and may be impossible for those with limited physical dexterity.

Due to inherent issues with soaps, some individuals lather up washcloths with a soap bar and use the washcloth for cleaning the body. However, conventional washcloths are difficult to lather up as a washcloth is held in one hand and the soap is held in the other hand and both are rubbed against each other to create lather. Soap often slips out of hand and further, lathering up a washcloth is difficult for individuals with limited physical dexterity. Individuals desire an improved washcloth that can easily lather up without the risk of the soap falling.

Even in hospitals, nursing homes and other care institutions, washing is done with the aid of normal washcloths. It is difficult for care provider as well as patient to lather up the washcloths and therefore, individuals desire a washcloth that can easily lather up using any conventional soap.

Therefore, there exists a long-felt need in the art for a unique washcloth that can be easily lathered. There is also a long-felt need in the art for an improved washcloth that obviates the need of applying a soap directly to the body during a bath. Additionally, there is a long-felt need in the art for an improved washcloth that can be used with any conventional soap bar for creating lather. Moreover, there is a long-felt need in the art for a washcloth that prevents accidental drops of soaps while lathering the washcloth. Further, there is a long-felt need in the art for a multipurpose washcloth that eliminates a slippery mess on the floor due to dropped soaps. Furthermore, there is a long-felt need in the art for a washcloth that can accommodate a soap bar thereby obviates the need of a user to separately hold the soap bar. Finally, there is a long-felt need in the art for an improved washcloth that can hold a soap bar and offers a safe and more convenient method of bathing while in the bath or shower.

The subject matter disclosed and claimed herein, in one embodiment thereof, comprises a soap bar holding pouched washcloth. The washcloth is designed as a multipurpose soft fabric washcloth with an integrated pouch wherein the pouch is used for storing a bar of soap for lathering the cloth for bathing. The washcloth obviates the use of independently applying the soap bar directly to the body by the user. The washcloth comprising a front surface and an opposite rear surface, the front surface has a pouch sewn along the longitudinal edges and one of the transversal edge of the front surface, a trailing edge of the washcloth forms an opening for a cavity created by the pouch for storing the soap bar wherein the soap bar does not come out of the pouch unless intentionally removed by a user thereby enabling the user to take a shower using the washcloth with the soap bar accommodated in the pouch. The soap bar creates lather when comes in contact with water enabling the user to clean the body by rubbing the lathered washcloth while the soap bar is stored in the pouch.

In this manner, the washcloth of the present invention accomplishes all of the forgoing objectives and provides users with a unique washcloth with a small pouch integrated into one side for holding a soap bar. The pouch is configured to accommodate the soap bar for creating lather easily without accidental drops of the soap bar and making a slippery mess on the floor. The washcloth can be applied on the body and therefore, obviates independently applying a soap bar on the body.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a soap bar holding pouched washcloth. The washcloth is designed as a multipurpose soft fabric washcloth with an integrated pouch wherein the pouch is used for storing a bar of soap for lathering the cloth for bathing. The washcloth has a one-piece structure and further comprising a front surface and an opposite rear surface, the front surface has a pouch sewn along the longitudinal edges and one of the transversal edges of the front surface, the length of the pouch is about 60% of the length of the front surface and the width of the pouch is about the same as the width of the front surface, a trailing edge of the washcloth forms an opening for a cavity created by the pouch for storing the soap bar, wherein the soap bar does not come out of the pouch unless intentionally removed by a user thereby enabling the user to take a shower using the washcloth with the soap bar accommodated in the pouch. The soap bar creates lather when it comes into contact with water enabling the user to clean the body by rubbing the lathered washcloth thereon. The washcloth is washable and can comprise different sizes and designs.

In yet another embodiment, a washcloth designed to have a small pouch integrated into one side for holding a soap bar is disclosed. The washcloth is configured to be used for a shower and obviates the need of applying a soap independently of the washcloth. The washcloth further comprising an integrated pouch designed to store a soap bar wherein the soap bar creates lather in the washcloth upon contacting with water. The lathered washcloth is applied directly on the body for cleaning without independent application of the soap bar and therefore, only one component is used for applying soap. The pouch is sized to securely accommodate the soap bar and therefore, prohibits the soap bar from falling on the shower or bath floor and reduces the risk of slips and falls. The washcloth is made of water permeable material and the pouch overlaps a portion of the one side of the washcloth wherein the pouch is sewn or sealed along three edges thereof.

In an additional embodiment of the presently described invention, the washcloth includes a pouched washcloth. The washcloth includes a front portion, the front portion has an integrated pouch for securely storing a soap bar, the pouch is sewn along longitudinal edges and one transversal edge of the front portion, thereby creating an opening for storing and removing the soap bar. The soap bar does not come out of the pouch unless intentionally removed by a user and therefore, the soap bar stored inside the pouch can be applied to the body of the user for cleaning the body. The soap bar creates lather in the washcloth unless the soap bar is completely dissolved by the water.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
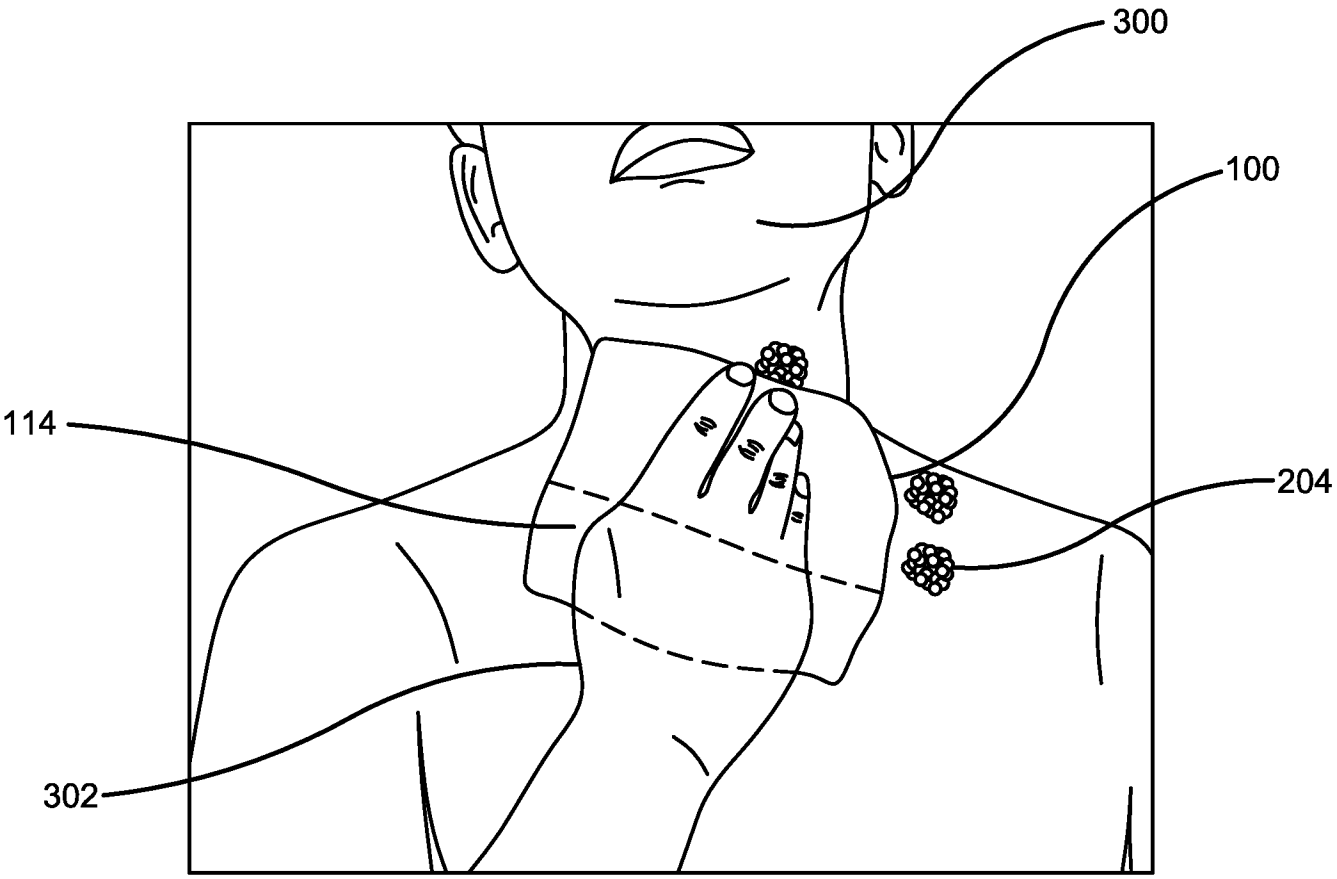
FIG. 1 illustrates a perspective view of one potential embodiment of a soap bar holding washcloth of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a unique washcloth that can be easily lathered. There is also a long-felt need in the art for an improved washcloth that obviates the need of applying a soap directly to the body during a bath. Additionally, there is a long-felt need in the art for an improved washcloth that can be used with any conventional soap bar for creating lather. Moreover, there is a long-felt need in the art for a washcloth that prevents accidental drops of soaps while lathering the washcloth. Further, there is a long-felt need in the art for a multipurpose washcloth that eliminates a slippery mess on the floor due to dropped soaps. Furthermore, there is a long-felt need in the art for a washcloth that can accommodate a soap bar thereby obviating the need of a user to separately hold the soap bar. Finally, there is a long-felt need in the art for an improved washcloth that can hold a soap bar and offers a safe and more convenient method of bathing while in the bath or shower.

The present invention, in one exemplary embodiment, is a novel pouched washcloth for washing, cleaning, and showering. The washcloth includes a front portion having an integrated pouch for securely storing a soap bar, the pouch is sewn along longitudinal edges and one transversal edge of the front portion, thereby creating an opening for storing and removing the soap bar. The pouch is about 60% of the size of the front surface and a trailing edge of the pouch is sewn partially so that the soap does not come out of the pouch unless intentionally removed by a user and therefore, the soap stored inside the pouch can be applied to the body of the user for cleaning the body. The soap creates lather in the washcloth unless the soap bar is completely dissolved by water.

It is noted that the term 'washcloth' in the present disclosure is not intended to mean an aid merely suitable for use in the activity of 'washing'. Besides being used for washing a human body, a washcloth according to the present invention can also be used, for example, in washing an animal, cleaning/treating vehicles, such as cars and mobile homes, and furniture, such as couches, etc. The washcloth may be manufactured from numerous water permeable materials, such as, for example, nylon or other synthetics; woven cloth of wool, linen, or cotton; synthetic fibers and felt cloth; and more.

Figure 2:
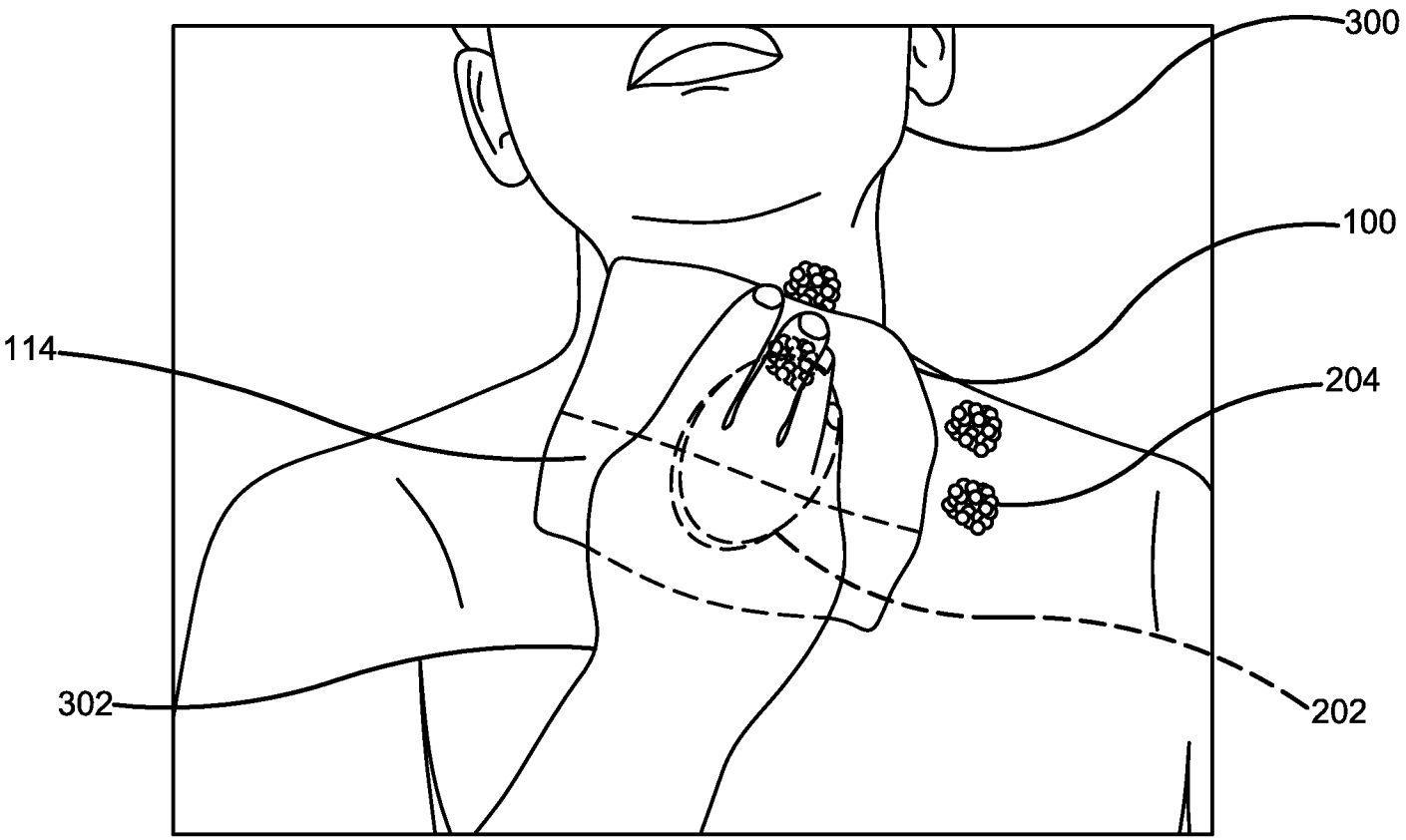
FIG. 2 illustrates a perspective view of the soap holding washcloth of the present invention accommodating a soap bar in a pouch and lathered up for use in accordance with the disclosed architecture.

Referring initially to the drawings, FIG. 1 illustrates a perspective view of one potential embodiment of a washcloth of the present invention in accordance with the disclosed architecture. The washcloth 100 of the present invention is designed as a multifunctional soft fabric washcloth with an integrated pouch disposed on one side for holding a soap bar. The washcloth 100 is generally rectangular or square and has a first surface 102 and an opposite surface 104. The surfaces 102, 104 have common longitudinal edges 106, 108, a common transversal top edge 110 and a common transversal bottom edge 112. A pouch 114 is disposed on the first surface 102 that forms a cavity 116 for securely holding at least one piece of soap bar as illustrated in FIG. 2. The pouch 114 is formed by sewing a piece of cloth along the common transversal bottom edge 112, a portion of the longitudinal edge 106, and an opposing portion of the longitudinal edge 108.

More specifically, the pouch 114 has a width equal to the length of the transversal bottom edge 112 and has a length of about 60% to about 70% of the length of the longitudinal edges 106, 108. A trailing edge 118 of the pouch 114 enables access of the cavity 116 for storing a soap bar to mix with water and form lather. The trailing edge 118 includes a sewn or stitched edge 119 and an unsewn or unstitched edge 120. In one exemplary embodiment, a majority of the trailing edge 118 of the pouch 114 is sewn 119 to the first surface 102 (i.e., about 60%-80% of a length of the trailing edge 118). The unsewn or unstitched edge 120 includes an opening of about four inches as denoted in edge 120 which forms the opening to the cavity 116. The cavity 116 is sized for preventing slipping of the soap inside the pouch 114 and for creating a good amount of lather when the soap bar is mixed with water.

The pouch 114 is integrated to the first surface 102 and provides adequate storage space for a soap bar and prohibits the soap bar from falling out. Further, the piece of fabric of which the pouch 114 is made can be the same or different from the fabric with which the first surface 102 and opposite surface 104 are made. The surfaces 102, 104 can be opposite surfaces of a single fabric or alternatively can be two different fabric portions sewn along mating edges. The pouch 114 can have a logo or any other indicia 122 disposed thereon for marketing or branding purposes.

The pouch 114 functions as a soap bar holder and overlaps a portion of the first surface 102 extending between the edges 106, 108. The washcloth 100 can come in different sizes, colors, and designs to meet requirements of different users and can be used for different purposes like washing a pet and more.

FIG. 2 illustrates a perspective view of the soap holding washcloth of the present invention accommodating a soap bar in a pouch and lathered up for use in accordance with the disclosed architecture. The pouch 114 of the washcloth 100 is used for accommodating a soap bar 202 such that the soap bar 202 produces lather 204 when mixed with water without requiring a user to separately hold the soap bar 202. The pouch 114 secures the soap bar 202 such that the soap bar 202 is removed only when a user intentionally removes the soap bar 202 from the pouch 114. Alternatively, another way of removal of the soap bar 202 from the pouch 114 is when the soap bar 202 is completely dissolved using the water. As described earlier, the opening of the pouch 114 caused by the unstitched portion 120 of the trailing edge 118 easily and securely enables a user to insert and remove the soap bar 202. It is to be appreciated that the unstitched portion 120 of edge 118 provides an opening for lengthwise insertion of the soap bar 202 and the cavity 116 provides space for the soap bar 202 to be rotated (i.e., 90 degrees) wherein the soap bar 202 can be positioned lengthwise along bottom edge 112.

The washcloth 100, including the pouch 114, can have a thickness of about 0.25 inches to about 1 inch thereby enabling efficient use in cleaning the body or any surface while preventing slipping of the soap bar 202. It should be appreciated that in other embodiments of the present invention, the washcloth can be used for massage by storing ice or any other cold material in the pouch. Further, the pouch is easily accessible, and a flap/lid is not required for securing the accommodated soap bar 202. The washcloth 100 is machine washable, reusable, and prevents slippage of any item stored in the pouch 114.

Figure 3:
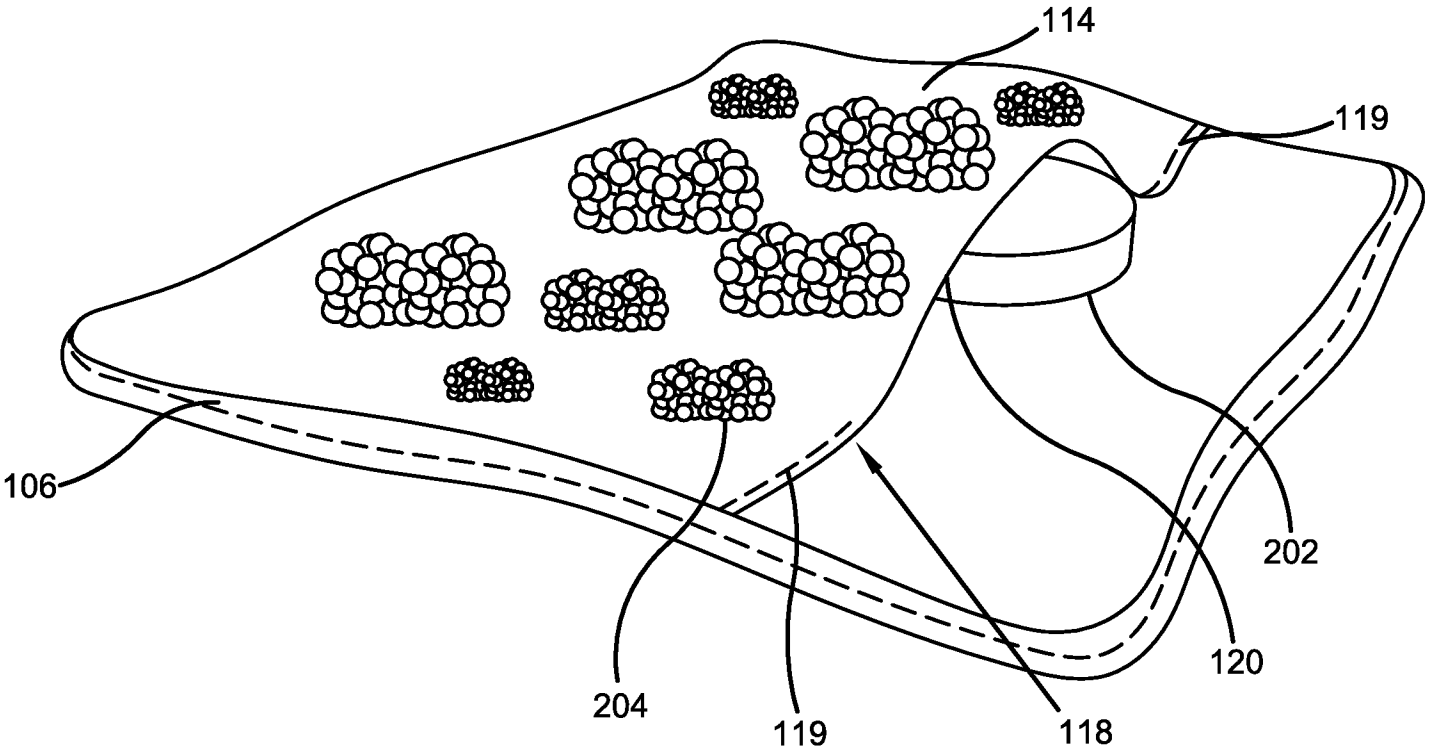
FIG. 3 illustrates a perspective view showing a user using the washcloth during a shower in accordance with the disclosed architecture.

FIG. 3 illustrates a perspective view showing a user using the washcloth 100 during a shower in accordance with the disclosed architecture. A user 300 can use the washcloth 100 for a shower or for any other purpose easily without fear of dropping the soap bar 202 from the hand 302. In use, the washcloth 100 with soap bar 202 securely accommodated inside the pouch 114 is mixed with water to create a lather 204 which can be held by the user 300 in one hand 302. The washcloth 100 is rubbed on body like a conventional washcloth for cleaning and the water permeable material of the washcloth 100 and pouch 114 enable creation of enough lather for an effective shower.

Even when the washcloth 100 is oriented upside down such that the pocket 114 faces downwards, the soap bar 202 does not fall out on its own unless intentionally taken out from pouch 114 by the user 300.

It should be appreciated that the washcloth of the present invention is extremely helpful to assist individuals with limited physical dexterity and who are not able to utilize a bar of soap as a separate item independent of the washcloth. The washcloth 100 has a one-piece structure and is easy to use and dry. In use, since the soap bar 202 is held inside the pocket 114, the soap bar 202 continues to produce lather 204 until the entire bar 202 is dissolved. Accordingly, any soap bar can be used.

Figure 4:
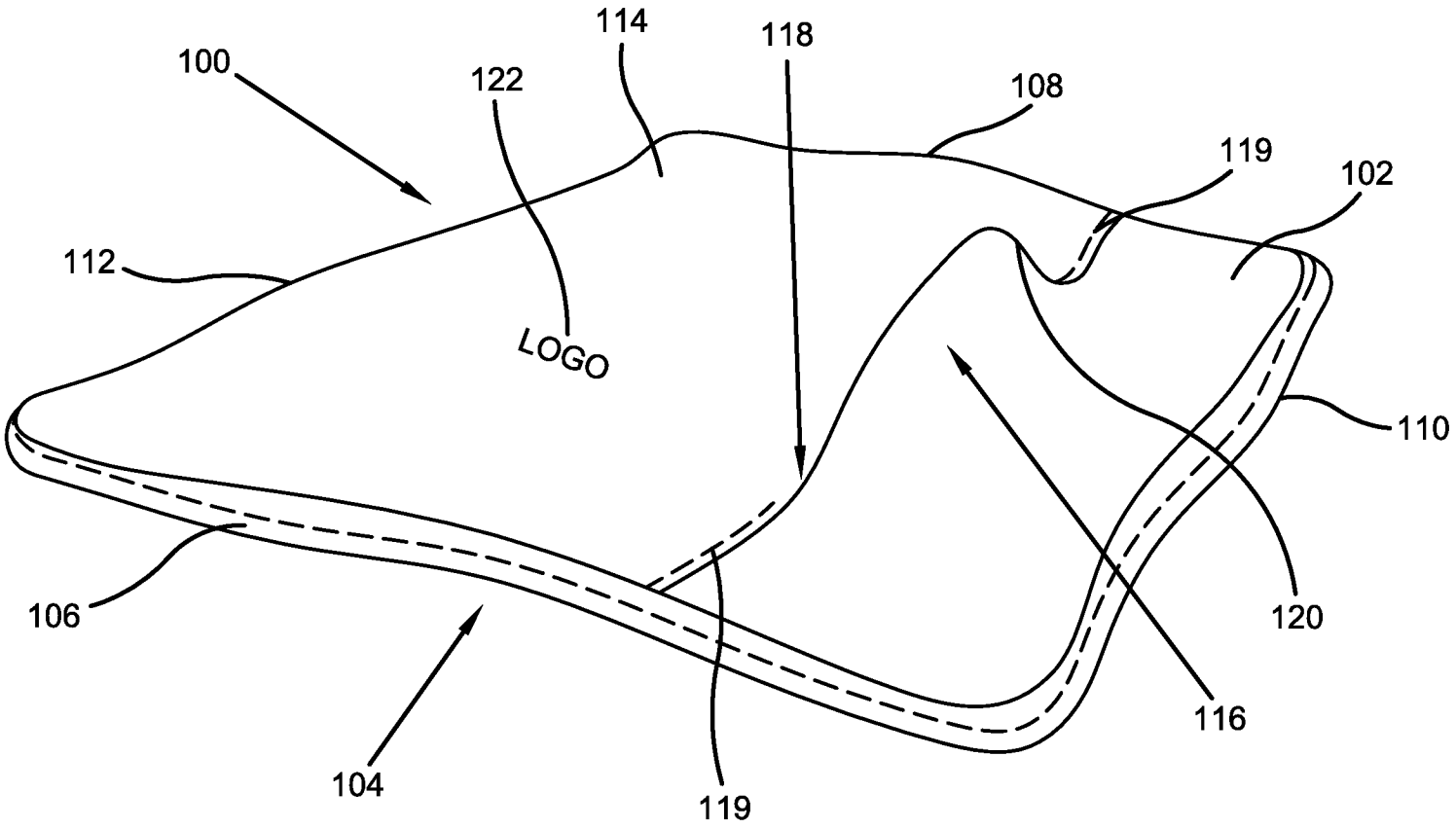
FIG. 4 illustrates a perspective view showing a user using the washcloth without the soap bar during a shower in accordance with the disclosed architecture.

The washcloth 100 can be used for showering or bathing by creating lather 204 without storing or accommodating the soap bar 202 as illustrated in FIG. 4.

It should be appreciated that the washcloth of various embodiments of the present invention effectively helps in better handling of a soap bar during showering and cleaning. Further, the washcloth can be used for accommodating the soap bar independently without asking for help from others.

The washcloth 100 may be of any suitable size and color to fulfil the needs of the users. The washcloth 100 may include a design or pattern on the front and back portions to provide additional aesthetic features. These designs or patterns could be brand names, logos, inspirational messages, or the like.

Certain terms are used throughout the following description and claims to refer to particular features or components. As one skilled in the art will appreciate, different persons may refer to the same feature or component by different names. This document does not intend to distinguish between components or features that differ in name, but not structure or function. As used herein "washcloth", "pouched washcloth", "soap holding washcloth", and "unique washcloth" are interchangeable and refer to the soap bar holding pouched washcloth 100 of the present invention.

Notwithstanding the forgoing, the soap bar holding pouched washcloth 100 of the present invention can be of any suitable size and configuration as is known in the art without affecting the overall concept of the invention, provided that it accomplishes the above stated objectives. One of ordinary skill in the art will appreciate that the soap bar holding pouched washcloth 100 as shown in the FIGS. are for illustrative purposes only, and that many other sizes and shapes of the soap bar holding pouched washcloth 100 are well within the scope of the present disclosure. Although the dimensions of the soap bar holding pouched washcloth 100 are important design parameters for user convenience, the soap bar holding pouched washcloth 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A washcloth for holding a soap bar, the washcloth comprising:

a pouch disposed on one side of said washcloth for holding the soap bar;

wherein said pouch is attached to said one side of said washcloth having at least three edges sewn to said one side of said washcloth;

wherein said pouch having a fourth edge partially secured to said one side of said washcloth;

wherein said fourth edge having a stitched portion secured to said one side of said washcloth and an unstitched portion unsecured to said one side of said washcloth; and wherein said unstitched portion forming an opening for insertion of the soap bar; and wherein said washcloth is a single piece of fabric; and wherein said washcloth is a woven cloth and said pouch is a nylon pouch.

2. The washcloth for holding a soap bar of claim 1, wherein said fourth edge is partially stitched.

3. The washcloth for holding a soap bar of claim 1, wherein said insertion of said soap bar is lengthwise.

4. The washcloth for holding a soap bar of claim 1, wherein said washcloth having a generally rectilinear shape.

5. The washcloth for holding a soap bar of claim 1, wherein said at least three edges comprising a common bottom edge, a portion of a first longitudinal edge, and a portion of a second opposing longitudinal edge.

6. The washcloth for holding a soap bar of claim 5, wherein said pouch having a width equal to a length of said common bottom edge, and further wherein said pouch having a length from about 60% to about 70% of a length of said first and said second longitudinal edges.

7. The washcloth for holding a soap bar of claim 1, wherein said stitched portion having a first length and said unstitched portion having a second length, and further wherein said first length is greater than said second length.

8. The washcloth for holding a soap bar of claim 7, wherein said second length is about four inches.

9. The washcloth for holding a soap bar of claim 1, wherein said fourth edge having an edge length and said stitched portion having a stitched length, and further wherein said stitched length is from about 60% to about 80% of said edge length.

10. The washcloth for holding a soap bar of claim 1, wherein said washcloth and said pouch having a combined thickness from about 0.25 inches to about 1.0 inches.

11. A washcloth for holding a soap bar, the washcloth comprising:

a pouch disposed on one side of said washcloth for holding the soap bar;

wherein said pouch is attached to said one side of said washcloth having at least three edges sewn to said first surface of said washcloth;

wherein said pouch having a fourth edge partially secured to said one side of said washcloth;

wherein said fourth edge having a stitched portion secured to said one side of said washcloth and an unstitched portion unsecured to said one side of said washcloth;

wherein said unstitched portion forming an opening for insertion of the soap bar;

wherein said fourth edge having an edge length and said stitched portion having a stitched length;

wherein said stitched length is from about 60% to about 80% of said edge length;

wherein said washcloth having a first material and said pouch having a second material; and wherein said first material and said second material are water permeable; and wherein said washcloth is a single piece of material; and wherein said pouch is a different material than said washcloth; and wherein said pouch is configured to allow the soap bar to rotate 90 degrees after inserted into the pouch.

12. The washcloth for holding a soap bar of claim 11, wherein said insertion of said soap bar is lengthwise.

13. The washcloth for holding a soap bar of claim 11, wherein said at least three edges comprising a common bottom edge, a portion of a first longitudinal edge, and a portion of a second opposing longitudinal edge.

14. The washcloth for holding a soap bar of claim 13, wherein said pouch having a width equal to a length of said common bottom edge, and further wherein said pouch having a length from about 60% to about 70% of a length of said first and said second longitudinal edges.

15. The washcloth for holding a soap bar of claim 11, wherein said opening is about four inches.

16. A washcloth for holding a soap bar, the washcloth comprising:

a pouch attached to one side of said washcloth for holding the soap bar having at least three edges sewn to said one side of said washcloth;

wherein said pouch having a fourth edge partially secured to said one side of said washcloth;

wherein said fourth edge having a stitched portion secured to said one side of said washcloth and an unstitched portion unsecured to said one side of said washcloth;

wherein said unstitched portion forming an opening for insertion of the soap bar;

wherein said stitched portion having a first length and said unstitched portion having a second length;

wherein said first length is greater than said second length;

wherein said washcloth having a first material and said pouch having a second material; and further wherein said first material is the same as said second material; and wherein said washcloth is a single piece of fabric; and wherein said pouch comprises an indicia disposed on an exterior surface of said pouch.

* * * * *